US007557505B2

(12) United States Patent
Mizuta

(10) Patent No.: US 7,557,505 B2
(45) Date of Patent: Jul. 7, 2009

(54) PLASMA DISPLAY PANEL PROVIDED WITH DISPLAY ELECTRODES WITHIN BARRIER RIBS

(75) Inventor: Takahisa Mizuta, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 503 days.

(21) Appl. No.: 11/115,527

(22) Filed: Apr. 26, 2005

(65) Prior Publication Data

US 2005/0242726 A1 Nov. 3, 2005

(30) Foreign Application Priority Data

Apr. 29, 2004 (KR) ..... 10-2004-0029885

(51) Int. Cl.
*H01J 17/49* (2006.01)

(52) U.S. Cl. ..... 313/582; 313/583; 313/587

(58) Field of Classification Search ..... 313/582–587
See application file for complete search history.

(56) References Cited

U.S. PATENT DOCUMENTS

| | | | | |
|---|---|---|---|---|
| 5,744,909 | A * | 4/1998 | Amano | 313/585 |
| 6,512,499 | B1 * | 1/2003 | Abe | 345/60 |
| 6,727,869 | B1 * | 4/2004 | Kosaka | 345/60 |
| 6,873,105 | B2 * | 3/2005 | Akiba | 313/586 |
| 7,038,382 | B2 * | 5/2006 | Hashikawa et al. | 313/582 |
| 7,161,300 | B2 * | 1/2007 | Zeng et al. | 313/587 |
| 7,256,545 | B2 * | 8/2007 | Woo et al. | 313/582 |
| 7,274,144 | B2 * | 9/2007 | Choi et al. | 313/582 |
| 2002/0008475 | A1 * | 1/2002 | Yoshioka et al. | 313/586 |

FOREIGN PATENT DOCUMENTS

| | | | |
|---|---|---|---|
| JP | 2000331615 | A * | 11/2000 |
| KR | 2003-0035741 | | 5/2003 |
| KR | 2003-0083564 | | 10/2003 |

OTHER PUBLICATIONS

Korean Patent Abstracts, Publication No. 1020030035741; Publication Date: May 9, 2003; in the name of Kazunori et al.
Korean Patent Abstracts, Publication No. 1020030083564; Publication Date: Oct. 30, 2003; in the name of Masayuki et al.

* cited by examiner

*Primary Examiner*—Mariceli Santiago
(74) *Attorney, Agent, or Firm*—Chritie Parker & Hale LLP

(57) ABSTRACT

A plasma display panel is provided. A first substrate faces a second substrate. Barrier ribs positioned between the first substrate and the second substrate form a plurality of polyhedral discharge cells. A plurality of display electrodes formed substantially along a first direction of the first substrate have portions placed at positions corresponding to at least three planes of the discharge cell's composing planes. A dielectric layer for the display electrode covers the display electrodes. A plurality of address electrodes formed along a second direction of the second substrate have portions placed at positions corresponding to at least one plane of the discharge cell's composing planes. A dielectric layer for the address electrode covers the address electrodes. A phosphor layer is formed inside the discharge cells.

28 Claims, 4 Drawing Sheets

PLASMA DISPLAY PANEL PROVIDED WITH DISPLAY ELECTRODES WITHIN BARRIER RIBS

CROSS-REFERENCE TO RELATED APPLICATION

This application claims the benefit of and priority to Korean Patent Application No. 10-2004-0029885, filed on Apr. 29, 2004 in the Korean Intellectual Property Office, the entire disclosure of which is incorporated herein by reference.

BACKGROUND OF THE INVENTION (a) Field of the Invention

The present invention relates to a plasma display panel (PDP) and, in particular, to a display electrode of the PDP.

(b) Description of the Related Art

A typical PDP is a display device in which vacuum ultraviolet rays from plasma generated by gas discharge excite phosphors to emit red (R), green (G), blue (B) visible light for producing an image. Such a PDP can achieve a large screen size over 60 inches while keeping its thickness within 10 cm. The PDP has features of excellent color reproduction and no distortion along its viewing angle. As compared to a liquid crystal display (LCD) device, the PDP has the advantage of a simple manufacturing process resulting in good productivity and low cost. As a result, the PDP has emerged as a promising flat display device for home and industry.

In a typical three-electrode type surface discharge PDP, address electrodes are formed on a rear substrate along a first direction. A dielectric layer is formed on the rear substrate to cover address electrodes. On top of the dielectric layer, barrier ribs positioned between the address electrodes are formed in a stripe pattern, and R, G and B phosphor layers are formed between the barrier ribs.

On a first surface of a front substrate facing the rear substrate. Display electrodes consisting of a pair of protrusion electrodes and a pair of bus electrodes are formed in a first direction crossing an address electrode. A dielectric layer and a protective layer in turn are formed on the entire front substrate covering the display electrodes.

Discharge cells are formed at locations where the address electrodes of the rear substrate cross a pair of the display electrodes of the front substrate.

Such a PDP adopts a driving method using memory characteristics to drive a large number of the discharge cells. A voltage difference over a certain value is necessary to start a discharge between a X electrode (or sustain electrode) and a Y electrode (or scan electrode), both forming a pair of the display electrodes. The certain voltage threshold is called the firing voltage Vf. When an address voltage Va is applied between the Y electrode and the address electrode, the discharge starts. The plasma is generated by the discharge in the discharge cell, and the electrons and ions in the plasma move toward the electrodes with the opposite polarity. As a result, electrical current flows.

Since the dielectric layer is coated on each electrode of an alternating current PDP, most of the moving space charge is deposited on the dielectric layer with the opposite polarity. Therefore, the net voltage difference across the gas between the Y electrode and the address electrode becomes smaller than the initial address voltage Va, and causes the discharge to be weak and disappear eventually. The dielectric layer on the Y electrode collects a relatively large amount of the ions, as compared to the dielectric layer on the X electrode. The accumulated charges on the dielectric layer over the X-Y electrodes are called the wall charge Qw. Also, the voltage across the space between the X-Y electrodes is called the wall voltage Vw.

When a discharge sustain voltage Vs is applied between the X electrode and the Y electrode successively, the discharge starts in the discharge cell when the sum Vs+Vw of the discharge sustain voltage Vs and the wall voltage Vw exceed the firing voltage Vf. Vacuum ultraviolet rays generated at this point excite the corresponding phosphor layer so that visible light is emitted and transmitted through the transparent frontal substrate.

In the case of no address discharge between the Y electrode and the address electrode (that is, the case that no address voltage Va is applied), however, there is no wall charge accumulated on the X-Y electrodes and therefore, no wall voltage. As a result, only the discharge sustain voltage Vs exists in the discharge cell between the X-Y electrodes. The resulting voltage is smaller than the firing voltage Vf so that the no discharge occurs in the gas between the X-Y electrodes.

In order to obtain the visible light as aforementioned, the conventional PDP requires many steps which are not efficient in terms of energy conversion. Therefore, a large consumption of electric power results, and consequently, the efficiency (a ratio of luminance to the power consumption) of the PDP is not as good as that of a cathode ray tube type of display device. Inside the PDP having the above-described structure, a face discharge occurs between the address electrode and the Y electrode, and requires a higher firing voltage as the discharge gap are increased. Also, as between the X electrode and the Y electrode, only a surface discharge occurs that is not efficient as compared to the face discharge.

SUMMARY OF THE INVENTION

In accordance with the present invention, a PDP is provided in which the efficiency is enhanced as well as the required voltage for the discharge is lowered by improving the structure of the electrodes causing the address discharge and the sustain discharge.

A PDP of the present invention is provided which includes a first substrate and a second substrate facing the first substrate. Barrier ribs are positioned between the first substrate and the second substrate, forming a plurality of discharge cells. A plurality of first display electrodes, adjacent to the first substrate, are formed along a first direction of the first substrate between the first substrate and the second substrate. A first dielectric layer is formed adjacent to the first substrate covering the first display electrodes. A plurality of second display electrodes is formed between the first substrate and the second substrate. A plurality of address electrodes, adjacent to the second substrate, is formed along a second direction of the second substrate between the first substrate and the second substrate. A second dielectric layer is formed adjacent to the second substrate covering the address electrodes. A phosphor layer is formed inside the discharge cells.

The second display electrode includes a second bus electrode positioned along the first direction of the first substrate. Branch electrodes protrude from the second bus electrode and are positioned along the second direction of the second substrate. The branch electrodes are substantially placed along the perimeter of the discharge cell.

The branch electrode includes a first branch electrode and a second branch electrode positioned apart from the first branch electrode with a predetermined gap, both the branch electrodes protruding from the second bus electrode and formed inside the barrier ribs along the second bus electrode.

In addition, the second bus electrode is formed inside the barrier ribs, and the barrier ribs may be formed into a lattice pattern. The second bus electrode may have approximately the same height as that of the barrier ribs and may be made of a metallic material.

The first display electrode includes a first bus electrode formed along the first direction of the first substrate. A protrusion electrode protrudes from the first bus electrode toward the center of the discharge cell. A pair of the protrusion electrodes facing each other and are positioned apart from each other with a predetermined gap for each discharge cell.

The address electrodes are formed having an enlarged area at a position corresponding to one of the protrusion electrodes, the enlarged area having a wider width than the area corresponding to the paired electrode. The protrusion electrode corresponding to the enlarged area of the address electrode is in one embodiment a scan electrode.

In accordance with another aspect of the present invention, a PDP of the present invention is provided which includes a first substrate and a second substrate facing the first substrate. Barrier ribs are positioned between the first substrate and the second substrate, forming a plurality of polyhedral discharge cells. A plurality of display electrodes is formed substantially along a first direction of the first substrate, having portions placed at positions corresponding to at least three planes of the discharge cell's composing planes. A dielectric layer for the display electrode covers the display electrodes. A plurality of address electrodes are formed along a second direction of the second substrate, having portions placed at positions corresponding to at least one plane of the discharge cell's composing planes. A dielectric layer for the address electrode covers the address electrodes. A phosphor layer is formed inside the respective discharge cells.

The display electrode includes a line-electrode formed along the first direction of the first substrate; and a plate-electrode, protruding from the line-electrode, corresponding to the side plane of the discharge space.

The plate-electrodes of the display electrodes are formed corresponding to a first plane of the first substrate and to a vertical plane perpendicular to the first plane of the first substrate, respectively. The plate-electrode for the vertical plane is formed inside the barrier ribs and substantially surrounds the perimeter of the discharge space. The plate-electrode for the vertical plane may be made of a metallic material. The plate-electrode for the first plane of the first substrate may be made of a transparent material.

The barrier ribs may be formed into a lattice pattern, and the plate-electrode for the vertical plane may have approximately the same height as that of the barrier rib.

The plate-electrodes for the first plane of the first substrate are positioned in pairs facing each other. The address electrode is formed having an enlarged area at a position corresponding to one plate-electrode for the first plane of the first substrate, the enlarged area having a wider width than the area corresponding to the paired plate-electrode for the first plane of the first substrate. The plate-electrode for the first plane of the first substrate corresponding to the enlarged area of the address electrode is preferably a scan electrode.

In still another aspect of the present invention, an electrode structure of a PDP is provided, the PDP having a first substrate and a second substrate facing the first substrate and having barrier ribs positioned between the first substrate and the second substrate forming a plurality of discharge cells, each discharge cell having a respective phosphor layer formed inside the respective discharge cell adapted to display images. A plurality of first display electrodes is formed adjacent to the first substrate along a first direction of the first substrate between the first substrate and the second substrate. A plurality of address electrodes is formed adjacent to the second substrate along a second direction of the second substrate between the first substrate and the second substrate. A plurality of second display electrodes is formed between the first substrate and the second substrate, the second display electrodes each having a second bus electrode positioned along the first direction of the first substrate with branch electrodes protruding from the second bus electrode and positioned along the second direction of the second substrate. The second bus electrodes and the branch electrodes are formed inside the barrier ribs. The first display electrode may include a first bus electrode formed along the first direction of the first substrate and a protrusion electrode protruding from the first bus electrode toward a center of a respective discharge cell and corresponding to a first plane of the discharge space. The branch electrodes may correspond to a second plane and a third plane of the discharge space, the second plane and the third plane being substantially perpendicular to the first plane. The address electrodes may correspond to a fourth plane of the discharge cell, the fourth plane being substantially parallel to the first plane. The barrier ribs may be formed into a lattice pattern.

DETAILED DESCRIPTION

Figure 1:
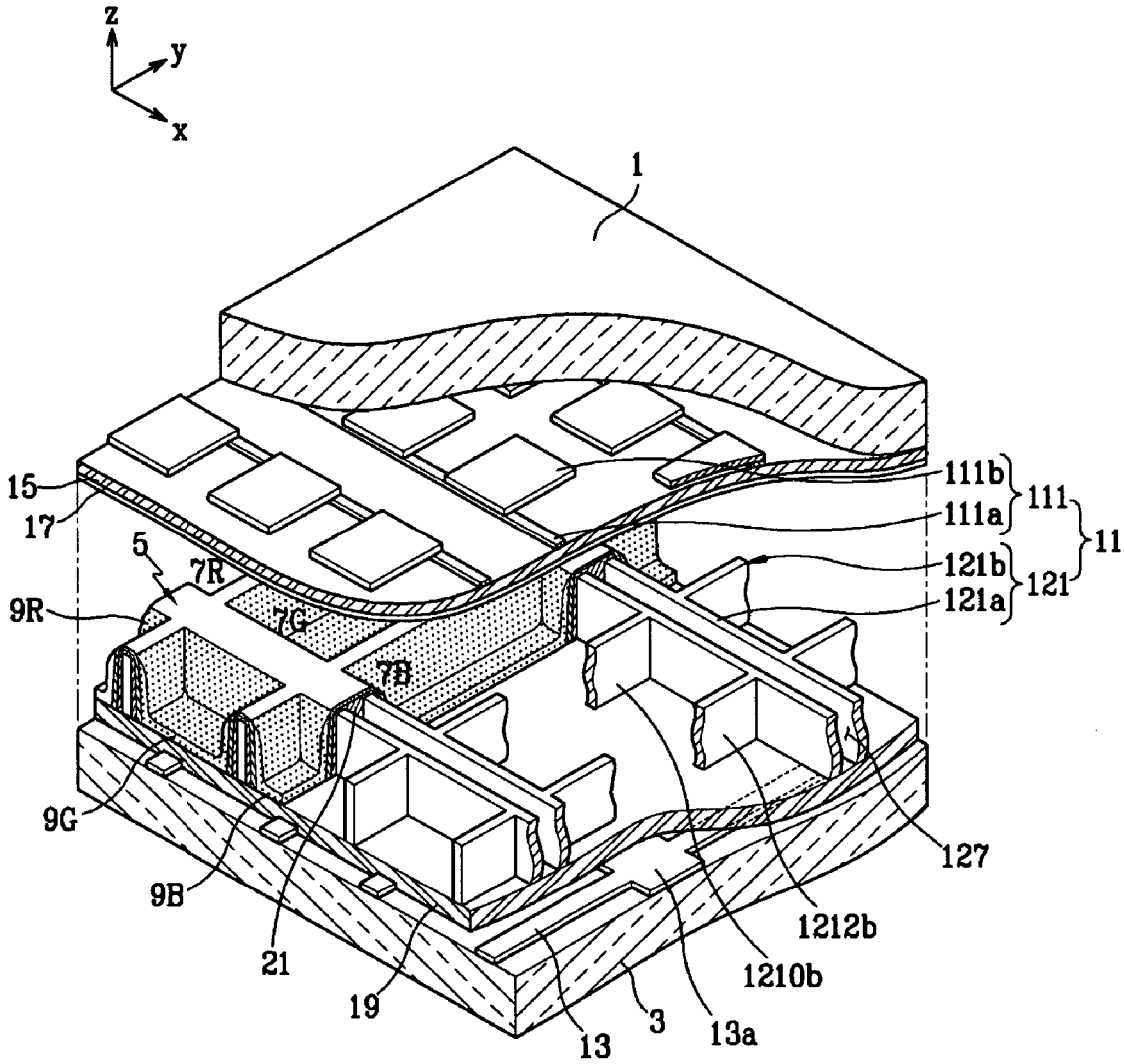
FIG. 1 is a partially exploded perspective view of a portion of a PDP according to an exemplary embodiment of the present invention.
Figure 2:
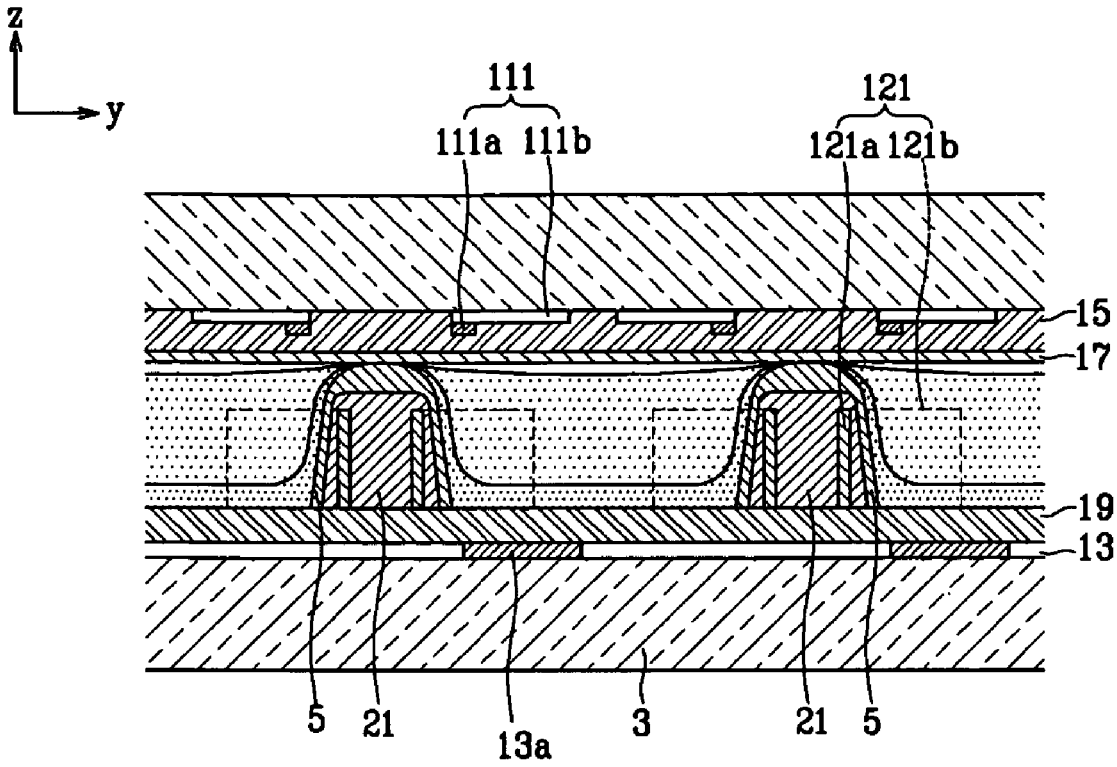
FIG. 2 is a partial cross-sectional view of the PDP of FIG. 1.
Figure 3:
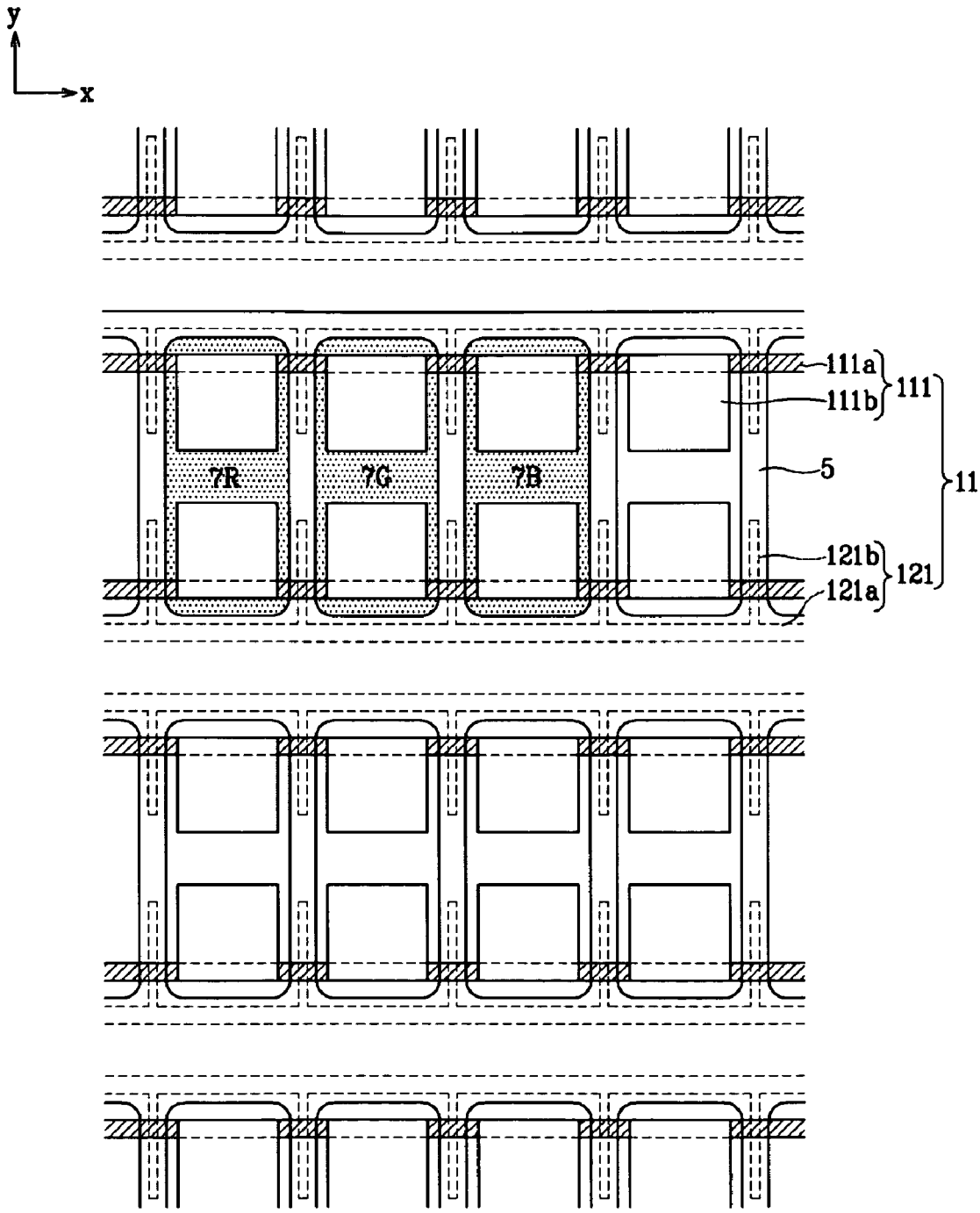
FIG. 3 is a schematic plan view showing a portion of the PDP of FIG. 1.

As shown in the drawings, a PDP in accordance with the present invention includes a first substrate 1 and a second substrate 3 facing the first substrate 1, both hermetically joined at their edges to form a vacuum tight vessel. Between the first substrate 1 and the second substrate 3, barrier ribs 5 form a plurality of discharge cells 7R, 7G, 7B by dividing the space therebetween. Since the discharge cells 7R, 7G, 7B are formed into polyhedral discharge spaces (for example, hexahedron), the discharge cell may be a closed space surrounded by the barrier ribs 5, the first substrate 1 and the second substrate 3. For example, the discharge cells 7R, 7G, 7B are formed in a lattice pattern.

Phosphor layers 9R, 9G, 9B are formed by painting R, G and B phosphors inside the discharge cells 7R, 7G, 7B.

In order to produce an image by visible light emitted from the gas discharge inside the PDP, the PDP includes principal electrodes, which are display electrodes and address electrodes. The electrodes are described in more detail below.

The display electrodes 11 of the present embodiment are classified into a first display electrode 111 and a second display electrode 121. A plurality of the first display electrodes 111 are adjacent to the first substrate 1 and positioned along a first direction (x-direction in the drawings) of the first substrate 1 between the first substrate 1 and the second substrate 3.

The first display electrode 111 includes a first bus electrode 111*a* formed in a line pattern along the first direction (x-direction in the drawings); and a protrusion electrode 111*b* protruding from the first bus electrode 111*a* and positioned apart from each other with a predetermined gap.

The first bus electrode 111*a* is made of a metallic material like silver (Ag). The first protrusion electrode 111*b* is formed into a plate shape, which is made of a transparent material such as indium-tin oxide (ITO). The first bus electrode 111*a* and the protrusion electrode 111*b* are positioned inside the discharge cells 7R, 7G, 7B. Each discharge cell 7R, 7G, 7B includes a pair of the protrusion electrodes 111*b*: one is a X-electrode (or sustain electrode), and the other is a Y electrode (scan electrode).

The second display electrode 121 is formed between the first substrate 1 and the second substrate 3 and corresponds to the arrangement pattern of the barrier ribs 5, as a whole.

In more detail, the second display electrode 121 includes a second bus electrode 121*a* that is positioned parallel to the first bus electrode 111*a*. Each discharge cell 7R, 7G, 7B includes a pair of the second bus electrodes 121*a* that are facing each other and positioned apart from each other with a predetermined gap. Since the second bus electrodes 121*a* have a height approximating the height of the barrier ribs 5, it is apparent that the height of the second bus electrode 121*a* is larger than the thickness of the first bus electrode 111*a*.

Figure 4:
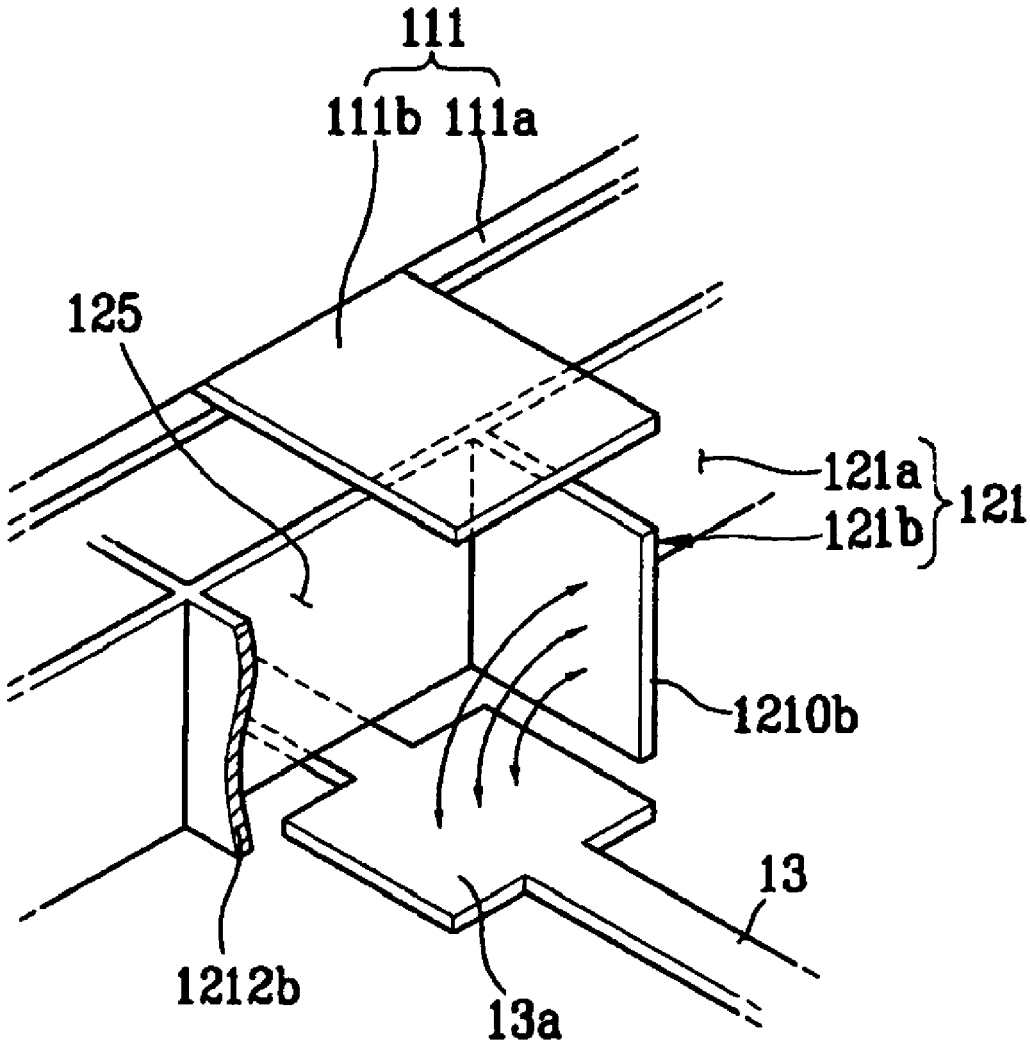
FIG. 4 is a partial perspective view showing a portion of the PDP according to the exemplary embodiment of the present invention.

The second bus electrode 121*a* has branch electrodes 121*b* protruding therefrom. The branch electrode 121*b* also have a height approximating the height of the barrier ribs 5. The branch electrode 121*b* in each discharge cell 7R, 7G, 7B consists of a first branch electrode 1210*b* and a second branch electrode 1212*b* placed apart from the first branch electrode 1210*b* with a predetermined gap 125, as seen in FIG. 4. Also, the first branch electrode 1210*b* and the second branch electrode 1212*b* are positioned with a predetermined gap 127 between the pair of the second bus electrodes 121*a*, as seen in FIG. 1. In an exemplary embodiment the branch electrode 121*b* protrudes approximately as long as the protrusion electrode 111*b* protrudes from the first bus electrode 111*a*.

With the structure described above, the second display electrodes 121 are positioned to surround most of the perimeter of the discharge space of the discharge cell 7R, 7G, 7B. The second display electrodes 121 of the present embodiment are formed to be embedded within the barrier ribs 5.

According to the structure described above, the display electrodes 11 of the present invention are placed at positions corresponding to at least three planes of the composing planes of the polyhedral discharge space of the discharge cell 7R, 7G, 7B.

In other words, the protrusion electrode 111*b* of the first display electrode 111 and the branch electrodes 121*b* are positioned corresponding to three planes of the discharge space. However, this layout of the display electrodes 11 is just an example, and the present invention is not limited thereby.

On the other hand, the address electrode 13 is formed adjacent to the second substrate 3 and along a second direction (y-direction of the drawings) of the second substrate 3 between the first substrate 1 and the second substrate 3.

In other words, the address electrode 13 is positioned along the direction crossing the direction of the display electrodes 11. A plurality of the address electrodes 13 are formed apart from each other with a predetermined gap that enables each address electrode to be placed in each discharge cell 7R, 7G, 7B.

In the region of the discharge cell 7R, 7G, 7B where the address electrode is positioned along the second direction (y-direction), the address electrode of the present embodiment is formed having locally an enlarged area 13*a* at a position corresponding to one protrusion electrode (e.g., a Y electrode/scan electrode) of a pair of the protrusion electrodes 111*b* of the first display electrode 111, the enlarged area having a wider width than the area corresponding to the paired protrusion electrodes 111*b*.

On the first substrate, in addition, a first dielectric layer 15 and a protective layer 17 are coated covering the first display electrodes 111. And, a second dielectric layer 19 is formed on the overall second substrate 3, covering the address electrodes 13.

Moreover, a third dielectric layer 21 may be formed inside the barrier rib 5, covering the second display electrodes 121.

The PDP of the present embodiment makes the interaction between the electrodes more effective because the gap for the address discharge between the address electrode and the display electrode is smaller than that of the previous PDP.

From the viewpoint of the address electrode of each discharge cell, the PDP of the present invention provides the display electrode (to be specific, the second display electrode inside the barrier rib) with a lower position. That can induce the address discharge at the display electrode close to the address electrode. Therefore, the address discharge can take place even at a voltage lower than that required for the address discharge in the conventional PDP. Also, the discharge efficiency can be enhanced due to the enlarged area of the address electrode corresponding to the scan electrode of the display electrode (see the arrows in FIG. 4).

Furthermore, the required voltage for the sustain discharge, i.e., the interaction between the display electrodes, can be lowered due to the display electrodes being closely positioned with respect to each other.

As explained above, the PDP of the present invention can cause sufficient discharge at a low voltage because the second display electrode of the improved display electrode serves like a hollow cathode to induce the discharge.

According to the PDP of the present invention, the improved structure of the display electrode can lower the required voltage for sufficient discharge to produce an image and has an advantage of reducing the power consumption due to the enhanced luminous efficiency.

Although an exemplary embodiment of the present invention have been described in detail hereinabove, it should be understood that many variations and/or modifications of the basic inventive concept taught therein will still fall within the spirit and scope of the present invention, as defined in the appended claims.

What is claimed is:

1. A plasma display panel comprising:

a first substrate;

a second substrate facing the first substrate;

barrier ribs between the first substrate and the second substrate, forming a plurality of discharge cells;

a plurality of first display electrodes adjacent the first substrate along a first direction between the first substrate and the second substrate;

a first dielectric layer adjacent the first substrate and covering the first display electrodes;

a plurality of second display electrodes between the first substrate and the second substrate, the second display electrodes being within the barrier ribs and having portions extending along a second direction;

a plurality of address electrodes adjacent the second substrate along the second direction between the first substrate and the second substrate;

a second dielectric layer adjacent the second substrate and covering the address electrodes; and a phosphor layer in the discharge cells.

2. The plasma display panel of claim 1, wherein the second display electrodes further comprise second bus electrodes along the first direction, and the portions extending along the second direction are branch electrodes protruding from the second bus electrodes along the second direction.

3. The plasma display panel of claim 2, wherein the branch electrodes are substantially along a perimeter of respective ones of the discharge cells.

4. The plasma display panel of claim 3, wherein the branch electrodes include first branch electrodes and second branch electrodes apart from the first branch electrodes by a gap, both first branch electrodes and the second branch electrodes protruding from the second bus electrodes.

5. The plasma display panel of claim 2, wherein the branch electrodes are inside the barrier ribs.

6. The plasma display panel of claim 2, wherein the second bus electrodes are inside the barrier ribs.

7. The plasma display panel of claim 6, wherein the barrier ribs are in a lattice pattern.

8. The plasma display panel of claim 2, wherein the second bus electrodes have approximately a same height as a height of the barrier ribs.

9. The plasma display panel of claim 2, wherein the second bus electrodes comprise a metallic material.

10. A plasma display panel comprising:

a first substrate;

a second substrate facing the first substrate;

barrier ribs between the first substrate and the second substrate, forming a plurality of discharge cells;

a plurality of first display electrodes adjacent the first substrate along a first direction between the first substrate and the second substrate;

a first dielectric layer adjacent the first substrate and covering the first display electrodes;

a plurality of second display electrodes between the first substrate and the second substrate, the second display electrodes being within the barrier ribs;

a plurality of address electrodes adjacent the second substrate along a second direction between the first substrate and the second substrate;

a second dielectric layer adjacent the second substrate and covering the address electrodes; and a phosphor layer in the discharge cells, wherein the first display electrodes include first bus electrodes along the first direction and protrusion electrodes protruding from the first bus electrodes toward a center of a respective one of the discharge cells.

11. The plasma display panel of claim 10, wherein the protrusion electrodes face each other and are apart from each other by a gap, and wherein the address electrodes have an enlarged area at a position corresponding to one of the protrusion electrodes, the enlarged area having a wider width than a width of an area corresponding to another of the protrusion electrodes facing the one of the protrusion electrodes.

12. The plasma display panel of claim 11, wherein the one of the protrusion electrodes corresponding to the enlarged area is a scan electrode.

13. A plasma display panel comprising:

a first substrate;

a second substrate facing the first substrate;

barrier ribs between the first substrate and the second substrate, forming a plurality of polyhedral discharge cells having composing planes;

a plurality of display electrodes within the barrier ribs and substantially along a first direction, and having portions at positions corresponding to at least three planes of the composing planes;

a first dielectric layer covering the display electrodes;

a plurality of address electrodes along a second direction, and having portions at positions corresponding to at least one plane of the composing planes;

a second dielectric layer covering the address electrodes; and a phosphor layer in the discharge cells.

14. The plasma display panel of claim 13, wherein the display electrodes comprise line-electrodes along the first direction of the first substrate and plate-electrodes protruding from the line-electrodes, corresponding to a side plane of a respective one of the discharge cells.

15. The plasma display panel of claim 14, wherein the plate-electrodes correspond to a first plane of the first substrate and to a plane perpendicular to the first plane of the first substrate, respectively.

16. The plasma display panel of claim 15, wherein the plate-electrodes corresponding to the plane perpendicular to the first plane are inside the barrier ribs.

17. The plasma display panel of claim 14, wherein the plate-electrodes corresponding to the plane perpendicular to the first plane substantially surround a perimeter of respective ones of the discharge cells.

18. The plasma display panel of claim 17, wherein the plate-electrodes corresponding to the plane perpendicular to the first plane comprise a metallic material.

19. The plasma display panel of claim 15, wherein the plate-electrodes corresponding to the first plane of the first substrate comprise a transparent material.

20. The plasma display panel of claim 13, wherein the barrier ribs are in a lattice pattern.

21. The plasma display panel of claim 15, wherein the plate-electrodes corresponding to the plane perpendicular to the first plane have approximately a same height as a height of the barrier ribs.

22. The plasma display panel of claim 14, wherein the plate-electrodes corresponding to the first plane of the first substrate are in pairs facing each other and wherein the address electrodes have an enlarged area at a position corresponding to one plate-electrode corresponding to the first plane of the first substrate, the enlarged area having a wider width than a width of an area corresponding to a paired plate-electrode corresponding to the first plane of the first substrate.

23. The plasma display panel of claim 22, wherein the plate-electrodes corresponding to the enlarged areas are scan electrodes.

24. An electrode structure of a plasma display panel having a first substrate and a second substrate facing the first substrate and having barrier ribs between the first substrate and the second substrate forming a plurality of discharge cells, each discharge cell having a respective phosphor layer in a respective discharge cell adapted to display images, the electrode structure comprising:

a plurality of first display electrodes adjacent to the first substrate along a first direction between the first substrate and the second substrate;

a plurality of address electrodes adjacent to the second substrate along a second direction between the first substrate and the second substrate; and a plurality of second display electrodes between the first substrate and the second substrate, the second display electrodes having second bus electrodes along the first direction and branch electrodes protruding from the second bus electrodes along the second direction, wherein the second bus electrodes and the branch electrodes are inside the barrier ribs.

25. The electrode structure of claim 24, wherein the first display electrodes include first bus electrodes along the first direction and protrusion electrodes protruding from the first bus electrodes toward a center of a respective discharge cell and corresponding to a first plane of the respective discharge cell.

26. The electrode structure of claim 25, wherein the branch electrodes correspond to a second plane and a third plane of the respective discharge cell, the second plane and the third plane being substantially perpendicular to the first plane.

27. The electrode structure of claim 25, wherein the address electrodes correspond to a fourth plane of the respective discharge cell, the fourth plane being substantially parallel to the first plane.

28. The electrode structure of claim 24, wherein the barrier ribs are in a lattice pattern.

* * * * *